US006805348B1

(12) United States Patent
Chen

(10) Patent No.: US 6,805,348 B1
(45) Date of Patent: Oct. 19, 2004

(54) BASEBALL BOARD GAME

(76) Inventor: Samuel Chen, Flat M, 3 floor, Kaiser Estate Phase 3Hok Yuen Street, Hunghom Kowloon (HK)

( * ) Notice: Subject to any disclaimer, the term of this patent is extended or adjusted under 35 U.S.C. 154(b) by 0 days.

(21) Appl. No.: 10/452,064

(22) Filed: Jun. 2, 2003

(51) Int. Cl.[7] ..... A63F 7/07
(52) U.S. Cl. ..... 273/108.32
(58) Field of Search ..... 273/108, 108.1, 273/108.3, 108.31, 108.32, 108.33, 108.53

(56) References Cited

U.S. PATENT DOCUMENTS

| | | | | | |
|---|---|---|---|---|---|
| 487,825 | A | * | 12/1892 | Curtis et al. | 273/108.31 |
| 968,249 | A | * | 8/1910 | Meeker | 273/108.31 |
| 1,585,556 | A | * | 5/1926 | Markham et al. | 273/108.31 |
| 2,448,837 | A | * | 9/1948 | Siberts | 273/108.31 |
| 2,631,854 | A | * | 3/1953 | Volman | 273/108.32 |
| 3,009,452 | A | * | 11/1961 | Barber et al. | 124/27 |
| 3,368,813 | A | * | 2/1968 | McGraw | 273/244.1 |
| 3,576,325 | A | * | 4/1971 | Naturale | 273/108.31 |
| 3,730,525 | A | * | 5/1973 | Maeda | 273/108.31 |
| 3,879,037 | A | * | 4/1975 | Cooke | 273/108.31 |
| 4,017,074 | A | * | 4/1977 | Roberts | 273/108.31 |
| 4,179,123 | A | * | 12/1979 | Tsukuda | 273/108.31 |
| 4,877,244 | A | * | 10/1989 | Burrows et al. | 273/108.31 |
| 5,183,266 | A | * | 2/1993 | Kohler | 273/108.32 |
| 5,409,221 | A | * | 4/1995 | Cohn | 273/108.31 |
| 6,032,854 | A | * | 3/2000 | Greer et al. | 229/301 |

* cited by examiner

*Primary Examiner*—Raleigh W. Chiu
(74) *Attorney, Agent, or Firm*—Clement Cheng

(57) ABSTRACT

A simulated baseball board game on an inclined simulated miniature field is designed for two players taking offense or defense positions. The offensive player uses a batting mechanism to hit a ball pitched by the defensive player. The defensive player fields the ball if hit. Holes on the playing field retain the ball based on odds of real baseball events. Rules govern contingency events.

11 Claims, 3 Drawing Sheets

BASEBALL BOARD GAME

BACKGROUND OF THE INVENTION

Many sports simulation board games have been developed not only to challenge and entertain, but also to simulate the feel of actual games. One of these games is the American baseball simulation board game.

Baseball is well adapted for a board simulation game. A baseball game has two teams of nine players each. The objective of each team is to win by scoring more runs than the opponent. Two teams play in turn between offense and defense. The offense team has each of its players in order attempt to hit the baseball thrown by a pitcher, who is positioned toward the home plate where the batter stands. A catcher squats behind home plate catching the ball thrown by the pitcher. The pitcher and the catcher are parts of the defense team, and other positions can be defined as pitcher, catcher, first-base, second-base, third base, shortstop, left fielder, center fielder, and center fielder.

Depending upon the location of the thrown baseball relative to the hitter and home plate, the pitch may be considered a ball or strike or may be hit by the batter if contact is made. Runs are typically scored by batters hitting singles, doubles, triples, and home runs which enable the batters to run from one base to the next and eventually to home plate to record the run. Each offensive player is permitted only three strikes before being called out.

Four balls are considered a walk, meaning the batter is allowed to advance onto the first base. A Ball is a pitch that not entering the strike zone in flight and is not swung at by the batter. If the pitch touches the ground and bounces through the strike zone it is a "ball." If such a pitch touches the batter, he shall be awarded first base.

The offensive player is out if a hit baseball is caught in the air by a defensive player within the playing field or in foul territory. The batter is out if the batter fails to run onto a respective base before he is thrown out at that respective base.

Classic simulated baseball board games were designed for dice play, in which players roll dice to simulate most of the movements happened on a baseball field, for example, a strike, a ball, a hit, or a run. In other words, the movements of the game are determined by how the die (or dice) rests after the player rolls the die (or dice).

However, one main disadvantage of this type of game is that it fails to truly simulate or represent the actual playing conditions of baseball. That is to say that rolling dice or spinning a spinner does not bear any relation to the skills and odds involved in a baseball game. These skills including pitching the baseball such that the batter misses his swing, hitting the baseball to score runs, and the positions the defense players field.

Other kinds of the previous development of simulated baseball board games are more advanced, by using batting and pitching mechanisms on the game board to simulate ball movement, having racks with lever attached to spring and handle simulating batting mechanism, and miniature mechanical defense fielders.

The disadvantage of some mechanical baseball games is that they fail to show the odds of playing a real baseball game. Odds for registering hits based on statistically proved samples show that, the chance for a single-base hit should be significantly higher than a third-base hit, and the odds for groundouts should be similar to fly outs.

SUMMARY OF THE INVENTION

Accordingly, it is a primary object of the present invention to develop a two player simulated baseball board game having a pitching mechanism, a batting mechanism and a fielding mechanism with a simulated baseball board game with a playfield in which it can be reflected to and truly simulates to the baseball game in real.

TECHNICAL FIELD

Figure 1:
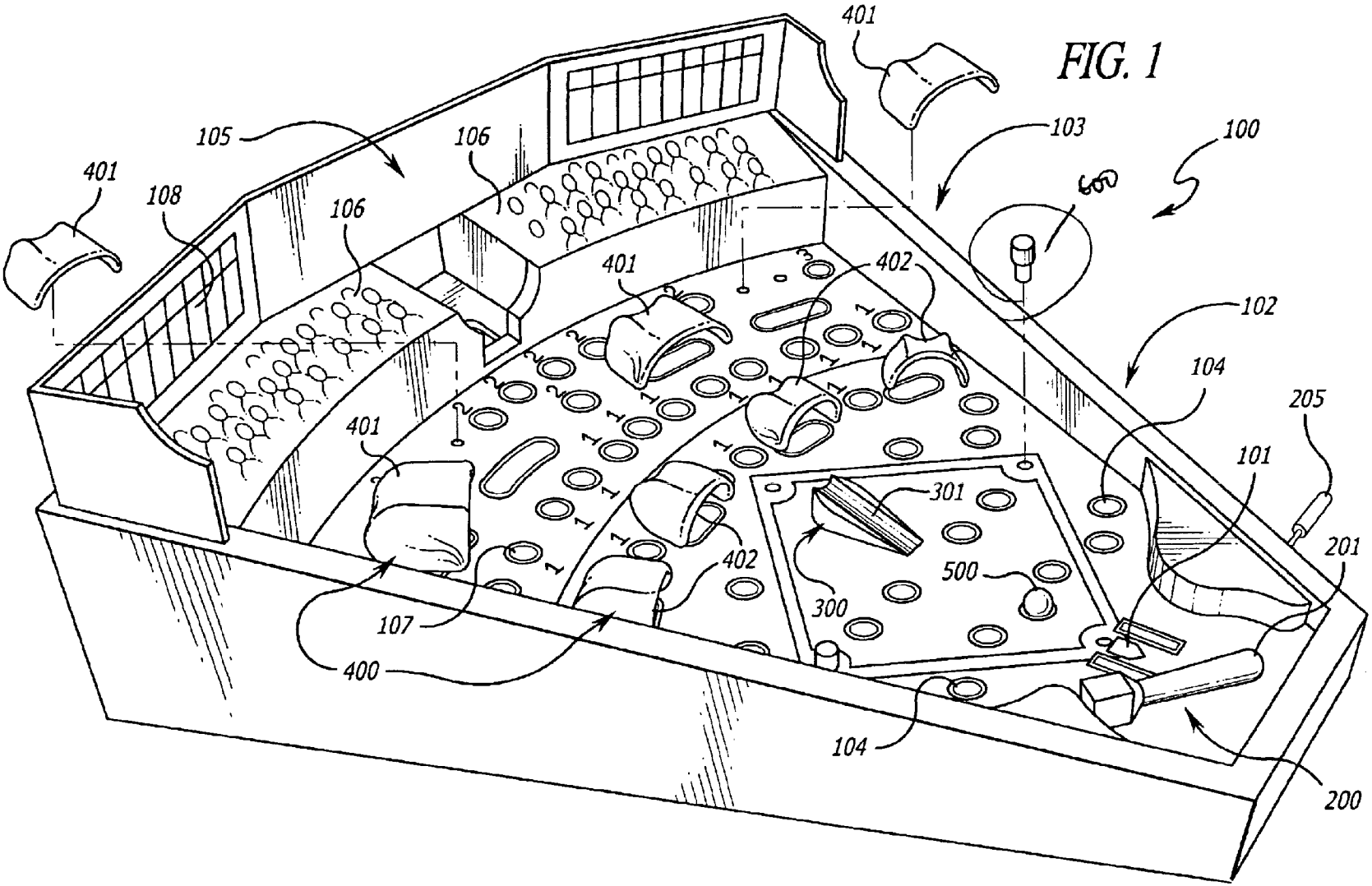
FIG. 1. is a perspective view of the baseball board game
Figure 2:
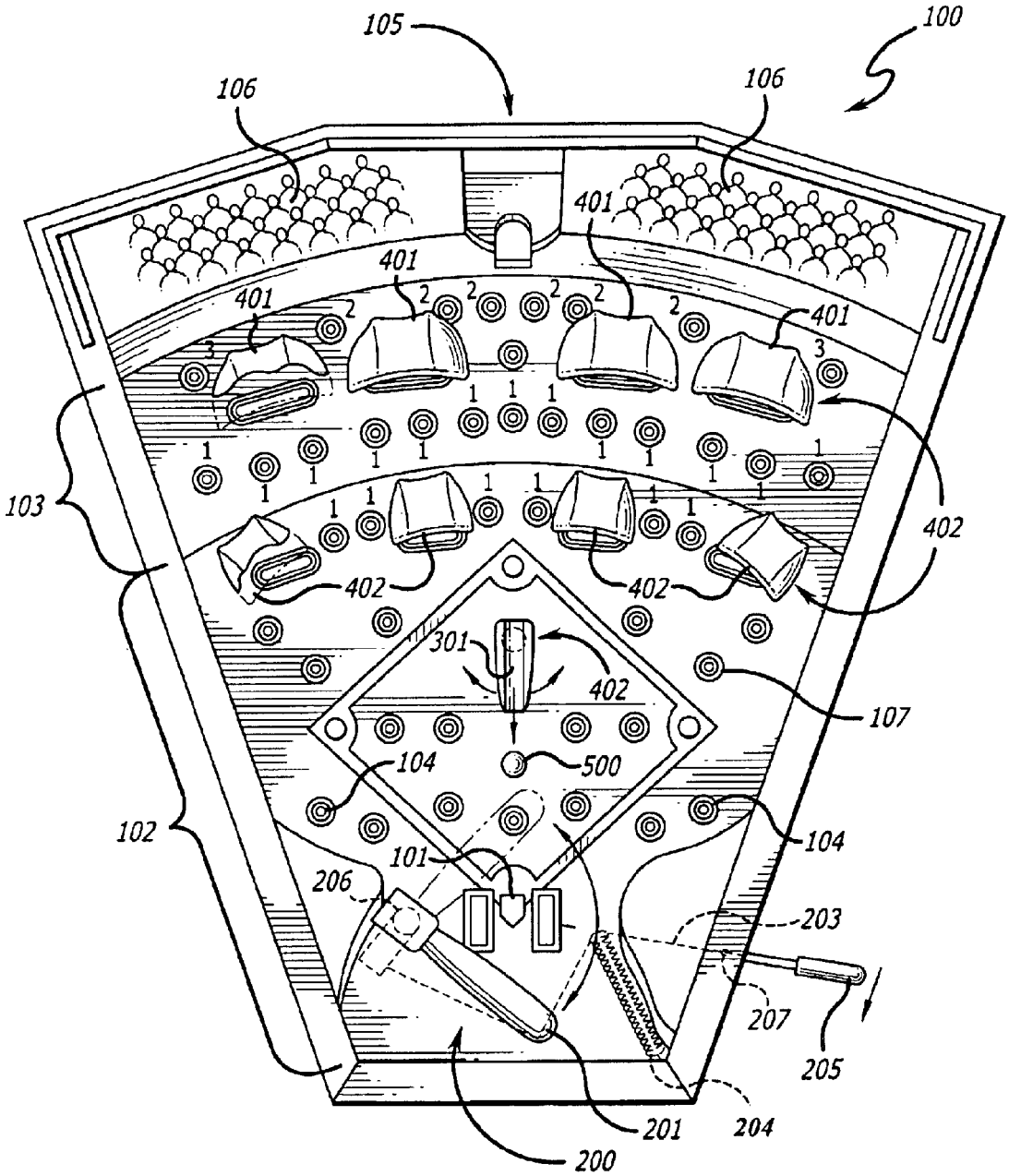
FIG. 2. is a top view of the baseball board game showing batting mechanism below FIG. 3. is a side view of a glove FIG. 4. is a side view of a pitching ramp
Figure 3:
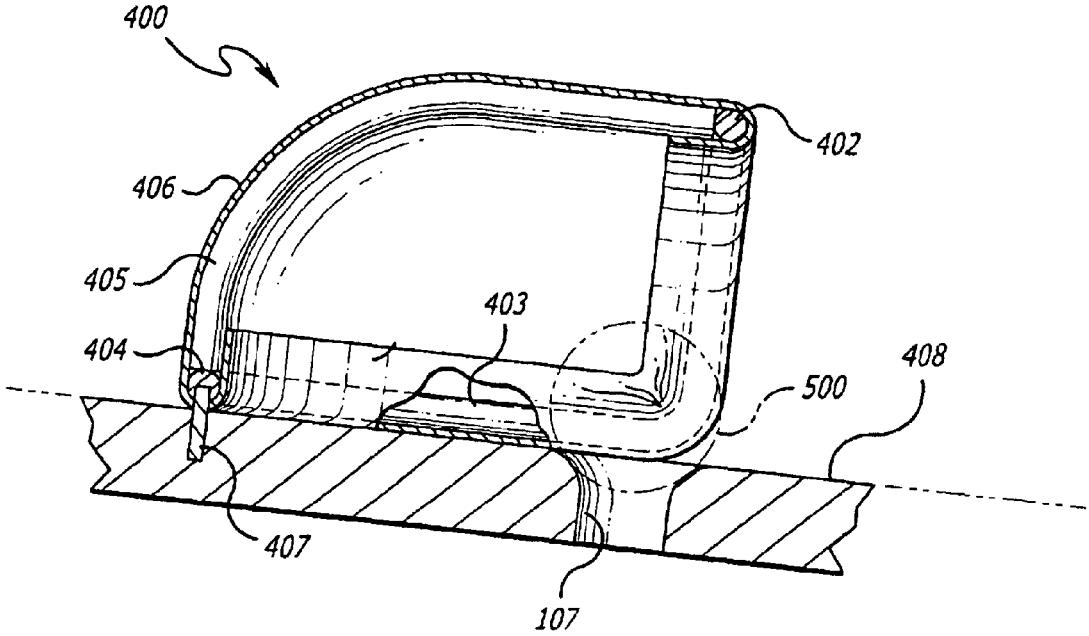
Figure 4:
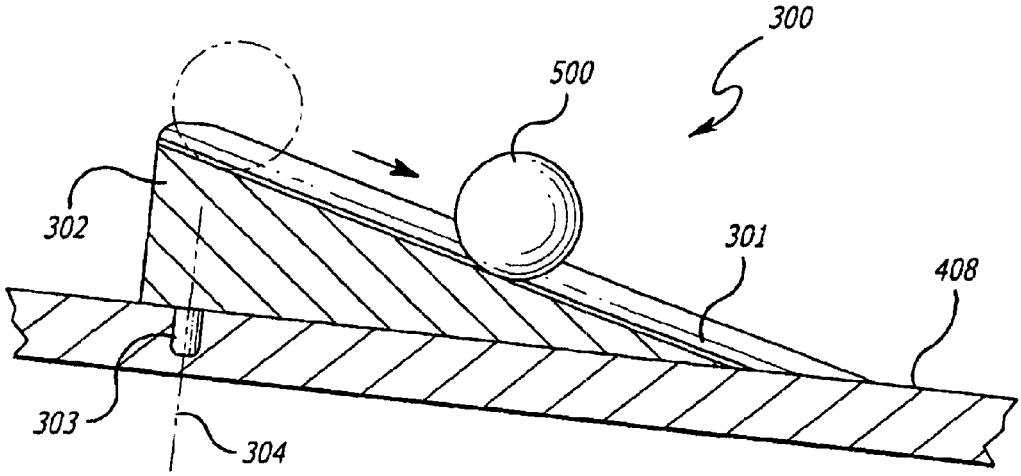

The present art relates to a baseball board game, and more particularly a simulated baseball board game with pitching and batting played on a simulated miniature field by opposing players.

DETAILED DESCRIPTION OF THE INVENTION

The board game has a rigid playfield 100 resembling miniature baseball stadium, including a batting mechanism 200, a pitching mechanism 300, fielding mechanisms 400, a home plate 101, an infield diamond 102, an outfield 103, foul territories 104, a homerun box 105, and audience seating sections 106. The rigid play field 100 may be formed of a planar sheet of fiberboard or plywood and then painted with appropriate baseball markings. The play field 100 is inclined as in pinball such that a spherical ball 500 rolls toward home plate 101. A stainless steel ball 500 used represents a baseball. The ball 500 can be pitched from a ramp 302 and hit by a bat-shaped paddle 201.

The bat-shaped paddle 201 hits the ball 500 along the field an into play where it may lodge in a depression in the field to score a double, triple, single, fly out or ground out. The ball 500 may also be hit up the pitching ramp groove 301 and into the stands for a home run. The stands are shaped to retain a ball 500 that flies up into the stands.

The batting mechanism 200 comprises a bat-shaped paddle 201 that swings to a manual pull on a side lever bat handle 205. The paddle 201 rotates along the axis of a perpendicular core shaft attached to the paddle 201. The batting paddle 201 is mechanically connected to the side lever bat handle 205 via the perpendicular core shaft. The side lever bat handle 205 is on the right side for right-handed players. A player can swing the bat-shaped paddle 201 softly and bunt the ball 500. A player can also swing the bat-shaped paddle 201 vigorously and hope to score a home run.

The bat-shaped paddle 201 swings from a resting position to an extended position. The spring 204 pulls the bat-shaped paddle 201 back and provides a restoring force to allow a user to release the bat handle 205 and retracted the bat-shaped paddle 201 from extended position. The other end of the shaft protrudes from the sidewall of the playing field 100 forming a lever 203 with a handle 205.

The pitching mechanism 300 comprises a ramp pitching stand 302 having an inclined groove 301 that slants downwardly toward the home plate 101. The inclined groove 301 is designed for the ball 500 to roll from the upper portion of the groove 301 toward the batting mechanism 200 located on the home plate 101, after the ball 500 is fed manually from the top upper portion of the groove 301. The ramp 302 can rotate left and right across a limited angle allowing a defensive player to pitch a slider, straight or curveball.

If a user fails to hit the ball 500, the ball will roll into a well that represents an out result. The well is shaped to retain the ball 500 within the playing field 100.

The glove-shaped fielding mechanisms 400 comprise seven glove-shaped apparatus simulating the seven defensive fielders in a baseball game. The three larger gloves 401 in the outfield 103 represent the outfielders and the four smaller gloves 402 in the infield 102 represent the infielders. Each glove has a swivel peg 303 mounted on it that inserts into a swivel peg hole in the playing field 100. The glove-shaped apparatus are adjustable by selecting from a number of swivel peg holes and pivoting the glove opening direction. The swivel peg 303 rotates freely within the swivel peg hole to allow the defender player to pivot and change the direction of the glove before pitching the ball 500.

The playing field 100 has a plurality of marked holes 107 spreading out over the infield 102 and outfield 103 on the playing field 100, being adapted to receive a hit ball 500 and being selectively designated to define a value, or a event, such as "hit", "foul", "fly out", or "ground out". This manner is designed to simulate the frequency and occurrence with which game events occur in a real baseball game. The depressions retain the ball 500 if the ball becomes lodged within the depression. When the ball 500 comes to rest in any depression, the play is over and the type of depression, or hole that the ball 500 falls into determines the result of the play. After the ball 500 comes to rest, a player picks up the ball 500 and records the play. The next play begins when the defensive player pitches the ball 500.

A depression is an area that retains a ball 500, and a hole 107 is a depression that defines an opening through the game board. A hole 107 less than the diameter of a ball 500 retains a ball 500 without allowing it to drop through the game board. A number of holes 107 through the game board is not necessary. Only a depression is necessary to retain a ball 500, but the use of holes 107 is preferred.

The gloves position over "out slots" so that a ball 500 caught in the glove will likely fall into the "out slot" that the glove extends over. Sometimes, the ball 500 falls out of the glove after entering the glove. If the ball 500 falls out of the glove after entering the glove, this simulates an outfielder 401 failing to field the ball 500.

The singles are predominantly placed in the outfield 103 between the infield 102 and the outfielders 401. The doubles are predominantly placed in the outfield 103 near or past the outfielders 401. The triples are located in the extreme corners of the field, one on a left side and one on a right side. The walks arc located in the infield 102. Other outs are located in the infield 102 and outfield 103. A plurality of pegs 600 representing runners on base fit into peg holes marked on the game board.

The ball 500 representing the baseball is usually made of steel and rolls along the flat baseball playing field 100. In a game of baseball, the batter can swing only once. Alternate rules allow a batter to swing more than once. A batter may swing at a ball 500 more than once if the ball 500 is hit and it does not lodge in any of the holes 107 or gloves. The bat-shaped paddle 201 is placed over the home plate 101 and return bumpers are placed to the left and right of the home plate 101 to direct the ball 500 to the back paddle 201 if the ball 500 is hit and does not lodge in any of the holes 107 or gloves. The return bumpers are aligned in a funnel shape and are analogous to pin ball 500 return bumpers.

Pitching allows a defensive player to select a pitching angle and manually slide a ball 500 down the ramp 302 and toward the home plate 101. Positioning the gloves also simulates positioning of outfielders 401 depending on batting strategy. Thus the defensive player participates in the play. The offensive player also participates in the play and swings at the pitch. The defensive player has a large role in the simulation game, which is similar to an actual baseball game.

The homerun box 105 is placed in the very rear. A batted ball 500 may be hit back up the pitcher's ramp 302 and land in the homerun box 105 in center field. Also, if a ball 500 hits the stands or scoreboard and bounces back on the playing field 100, it is also considered a home run. Because the ball 500 is pitched on the surface of the playing field 100 and hit along the surface of the playing field 100, the ball 500 usually rolls and there is a low likelihood of the ball 500 flying into the stands in the rear of the stadium. Optionally, a groove 301 is cut into the middle rear of the stadium wall so that it becomes easier for a player to hit the ball 500 through the groove 301 and into the homerun box 105. The groove 301 creates an opening and communicates with the homerun box 105. The home-run box is preferably placed directly behind the center field.

The field is placed in the stadium and recessed. Stadium walls enclose the field and retain the ball 500 during the play of the game. In the outfield 103, the rear stadium walls rise up about 4 in. and define the stands. The stands are an area behind the rear stadium walls and represents actual stands having sports spectators. A picture of spectators can be painted on the stands. The stands are made of a flat planar shape behind the rear stadium walls.

The players additionally decide to move base runners depending upon strategy. Dice rolls determine success or failure of base running and pegs 600 placed on bases represent runners on base. The game decisions determined by dice rolls can use a six sided die, or an eight sided die or a ten sided die.

The base running is determined by a set of rules. The rules usually assume that baseball players (runners) have similar physical skills. The odds are fair and even. This is the best mode because it is simple and easy to remember.

Alternatively, a team may be selected by randomly dealing a stack of cards such as baseball cards. Each card represents a player and each player may have personalized modified statistical odds for base stealing, and base running. A player may for example have a plus one added to his base stealing dice roll to represent improved odds of stealing a base. In this case, actual cards can be used for picking fantasy teams. Fantasy teams are teams that are created by modeling fantasy players from actual baseball players. Alternatively, players may choose to form teams of actual major league baseball teams that may use recent or past season statistics.

Standard Rules of the Game

All standard baseball rules are in effect such as 3 outs for each team per inning, 9 innings to complete each game (unless tied). Game rules reflect standard baseball rules. The game rules arc a means for determining game events including the advancement of runners on bases, stealing of bases, advancement of extra bases, grounding out, flying out, and striking out. The following rules are the best mode.

1. Offence a. means for determining a Walk . . . when a batted ball lands in a hole marked with a "W", runner (peg) should be placed at first base.

b. means for determining a Single . . . when batted ball lands in a hole marked with a "1"

c. means for determining a Double . . . when batted ball lands in hole marked with a "2"

d. means for determining a Triple . . . when batted ball lands in a hole marked with a "3"

e. means for determining a HOME RUN . . . when batted ball is hit back up the pitcher's ramp and, as a result, lands in the Homerun Box in center field. Also, if ball hits stands or scoreboard and bounces back unto the playing field, that shall be considered a HOME RUN.

f. means for determining a Stealing of a base . . . $2^{nd}$ or $3^{rd}$ . . . Prior to a pitch, the team at bat may declare he intends to attempts a steal. Each player shall then roll the dice. If the batting team rolls the higher number the steal attempt is successful. If the team in the field rolls the higher number the base runner is out.

If both roll the same number that is a foul ball and runner goes back to previously occupied base.

If a runner is on third base and wants to attempt to steal home, the batting team only will roll the dice. Batting team will declare what number he wants to roll. If that number is rolled, steal of home is successful. If number is not rolled, the runner is out.

With multiple runners on base the same rules apply but only to the lead runner. The trailing base runner will always advance automatically.

2. Defense

The defensive team has the option of repositioning the defenders by adjusting the 3 outfielders' "gloves" in three of the four positions in the outfield and the 4 infielders' gloves in the infield. The gloves can be adjusted by moving them into the desired pegged holes. Although the pitching ramp is also considered an infielder, the pitching clement is not a glove that can retain the ball.

a. means for determining a Ground out . . . when a batted ball lands in any of the holes circled in red in the infield it is considered a ground out.

b. means for determining a Ground out with base runners in force situation ($1^{st}$ base, $1^{st}$ & $2^{nd}$ base, bases loaded) . . . Each player will roll the dice. If the batting team rolls the higher number, only the lead runner is out. If the defenders roll the higher number then a double play will be rewarded. In the case of multiple base runners ($1^{st}$ & $2^{nd}$, bases loaded), the lead runner as well as the batter will be declared out.

c. means for determining a Fly out . . . when a batted ball lodges in any of the holes circled in red (whether they are covered by a glove or not) is considered a fly out.

d. means for determining a Strike out . . . If the batter swings and misses (only once) that is a strikeout.

3. Game Situation Decisions a. means for determining a Ground out with runners in non-force situation ($2^{nd}$ base, $2^{nd}$ & $3^{rd}$ base, $3^{rd}$ base) . . . Batting team will declare if he wants to try to advance the runner(s). If batting team chooses not to advance, the ground out will remain in effect. If the batting team wants to attempt to advance, then each player shall roll the dice. If defending team rolls the same or higher number the lead runner is declared out and the batter is safe at first. If the batting team rolls a higher number all runners advance, batter is safe at first with fielder's choice, and is not out.

b. means for determining a Fly out with runners on base . . . . Batting team will declare if he wants to try to advance the runner by tagging up. Each player shall role the dice. If batting team rolls the higher number the base runner advances. If defending team rolls the higher number the base runner is declared out.

c. means for determining Extra base advancement . . . . Normally the runners will advance only in increments of the value of the hit . . . i.e. a runner on first will go to $2^{nd}$ on a single or $3^{rd}$ on a double etc. If the batting team decides they wish to attempt an extra base advancement they declare their intentions. Each team will roll the dice. If the batting team rolls the higher number the base runner successfully advances to the extra base. If the defending team rolls the higher number the lead base runner is out. In each case, however, the trailing runner advances an extra base.

Call Out List of Elements

100. Playing Field
- 101. Home Plate
- 102. Infield
- 103. Outfield
- 104. Foul Territories
- 105. Homerun Box
- 106. Audience Seating Section
- 107. Holes

200. Batting Mechanism
- 201. Bat-Shaped Paddle
- 202. Rack
- 203. Lever
- 204. Spring
- 205. Side Lever Bat Handle

300. Pitching Mechanism
- 301. Ramp Groove
- 302. Ramp
- 303. Ramp Swivel Peg
- 304. Ramp Swivel Axis

400. Fielding Mechanism
- 401. 3 Outfielders
- 402. 4 Infielders
- 403. Side part of Glove
- 404. Rear part of Glove
- 405. Glove Body
- 406. Glove Cover
- 407. Glove Swivel Peg

500. Ball

600. Pegs

What is claimed is:

1. A baseball board game comprising:

a miniature baseball stadium structure;

a planar baseball playing field located within the baseball stadium structure, the planar baseball playing field has an infield and an outfield on the baseball playing field, and a foul ball area to the left and right of the infield;

a spherical ball representing a baseball;

a first base, a second base, a third base, and a home base on the baseball playing field; marked holes and slots on the baseball playing field, adapted to retain the spherical ball wherein each hole corresponds to a baseball game event and marked according to a baseball game event including a "single", "double", "triple", "ground out", and "fly out";

a pitching ramp representing a baseball pitching mound on the baseball playing field, the ramp having a groove receiving the ball such that the ball manually released from the top of the ramp rolls down the ramp within the groove and toward home plate;

a batting mechanism comprising a paddle bat coupled to a bat handle, wherein manual manipulation of the bat handle swings the paddle bat, wherein the offensive player may swing the paddle bat at the ball pitched from the ramp and rolling toward home plate;

a set of seven fielding gloves mounted on the baseball playing field comprising three outfielder gloves and four infielder gloves; the gloves partially enclosing an out slot, the out slot retains the ball when the batter hits the ball into the glove, a rear stadium wall groove behind the center field opening the home-run box behind the center field to the outfield, wherein the rear stadium wall groove does not reach the surface of the playing field so that a ball cannot roll into the homerun box through the rear stadium wall groove, wherein the glove is pivotally mounted on a glove retaining rod inserted in a glove retaining rod hole, said glove pivoting left and right by manual manipulation by a defensive player, the infield and outfield having multiple glove retaining rod holes allowing repositioning by manual manipulation by the defensive player, wherein singles holes are placed in the outfield between the infield and the outfielders, the doubles holes are placed in the outfield near or past the outfielders, the triples holes are located in the extreme corners of the field, one on a left side and one on a right side, the walks holes are located in the infield.

2. A baseball board game comprising:

a miniature baseball stadium structure;

a planar baseball playing field located within the baseball stadium structure, the planar baseball playing field has an infield and an outfield on the baseball playing field, and a foul ball area to the left and right of the infield;

a spherical ball representing a baseball;

a first base, a second base, a third base, and a home base on the baseball playing field;

marked holes and slots on the baseball playing field, adapted to retain the spherical ball wherein each hole corresponds to a baseball game event and marked according to a baseball game event including a "single", "double", "triple", "ground out", and "fly out";

a pitching ramp representing a baseball pitching mound on the baseball playing field, the ramp having a groove receiving the ball such that the ball manually released from the top of the ramp rolls down the ramp within the groove and toward home plate;

a batting mechanism comprising a paddle bat coupled to a bat handle, wherein manual manipulation of the bat handle swings the paddle bat, wherein the offensive player may swing the paddle bat at the ball pitched from the ramp and rolling toward home plate;

a set of seven fielding gloves mounted on the baseball playing field comprising three outfielder gloves and four infielder gloves; the gloves partially enclosing an out slot, the out slot retains the ball when the batter hits the ball into the glove; and a rear stadium wall groove behind the center field opening the home-run box behind the center field to the outfield, wherein the rear stadium wall groove does not reach the surface of the playing field so that a ball cannot roll into the homerun box through the rear stadium wall groove.

3. A baseball board game comprising:

a miniature baseball stadium structure;

a planar baseball playing field located within the baseball stadium structure, the planar baseball playing field has an infield and an outfield on the baseball playing field, and a foul ball area to the left and right of the infield;

a spherical ball representing a baseball;

a first base, a second base, a third base, and a home base on the baseball playing field;

marked holes and slots on the baseball playing field, adapted to retain the spherical ball wherein each hole corresponds to a baseball game event and marked according to a baseball game event including a "single", "double", "triple", "ground out", and "fly out";

a pitching ramp representing a baseball pitching mound on the baseball playing field, the ramp having a groove receiving the ball such that the ball manually released from the top of the ramp rolls down the ramp within the groove and toward home plate;

a batting mechanism comprising a paddle bat coupled to a bat handle, wherein manual manipulation of the bat handle swings the paddle bat, wherein the offensive player may swing the paddle bat at the ball pitched from the ramp and rolling toward home plate; a set of seven fielding gloves mounted on the baseball playing field comprising three outfielder gloves and four infielder gloves; the gloves partially enclosing an out slot, the out slot retains the ball when the batter hits the ball into the glove; and wherein the pitching ramp pivots so that a defensive player may pitch the ball by first pivoting the pitching ramp left or right defining a pitching angle and second manually rolling the ball from the pitching ramp so the ball rolls toward home base, wherein the pitching ramp pivoting angle is limited between a slider and a curve ball pitching angle.

4. The baseball board game of claim 3, wherein the glove is pivotally mounted on a glove retaining rod inserted in a glove retaining rod hole, said glove pivoting left and right by manual manipulation by a defensive player, the infield and outfield having multiple glove retaining rod holes allowing repositioning by manual manipulation by the defensive player.

5. The baseball board game of claim 3, wherein singles holes are placed in the outfield between the infield and the outfielders, the doubles holes are placed in the outfield near or past the outfielders, the triples holes are located in the extreme corners of the field, one on a left side and one on a right side, the walks holes are located in the infield.

6. A baseball board game method of play comprising the steps of:

providing a miniature baseball stadium structure; providing a planar baseball playing field located within the baseball stadium structure, the planar baseball playing field has an infield and an outfield on the baseball playing field, and a foul ball area to the left and right of the infield; providing a spherical ball representing a baseball; providing a first base, a second base, a third base, and a home base on the baseball playing field; a pitching ramp representing a baseball pitching mound on the baseball playing field, the ramp having a groove receiving the ball such that the ball released from the top of the ramp rolls down the ramp within the groove and toward home plate; providing a batting mechanism comprising a paddle bat coupled to a bat handle, wherein manual manipulation of the bat handle swings the paddle bat, wherein the offensive player swings the paddle bat to hit the ball pitched from the ramp that rolls toward home plate; providing a set of seven fielding gloves mounted on the baseball playing field comprising three outfielder gloves and four infielder gloves; the gloves partially enclosing an out slot, the out slot retains the ball when the batter hits the ball into the glove; providing marked holes on the baseball playing field, adapted to receive the spherical ball into the marked hole wherein each hole corresponds to a baseball game event and marked according to a baseball event including:

a. a walk when a batted ball lands in a walk hole, b. a Single when batted ball lands in a Single hole, c. a Double when batted ball lands in Double hole, d. a Triple when batted ball lands in a Triple hole, e. a "ground out", when batted ball lands in a ground out hole or slot, f. a "fly out", when batted ball lands in a fly out hole or slot, advancing runners according to baseball events, simulating stealing $2^{nd}$ or $3^{rd}$ base by dice rolls, simulating stealing home for a runner on third base by dice rolls, simulating repositioning of 3 outfielders and 4 infielders by allowing the defensive player to adjust gloves by moving into desired pegged holes;

simulating a ground out with runners in non-force situation by dice rolls, simulating a fly out with runners on base situation by dice rolls, simulating a extra base advancement by dice rolls, simulating extra base advancement requires runners that normally advance only in increments of the value of the hit may advance an extra base by the batting team declares an extra base advancement, and each team rolls a die, if the batting team rolls the higher number the base runner successfully advances to the extra base, but if the defending team rolls the higher number the lead base runner is out, wherein in each case the trailing runner advances an extra base.

7. The baseball board game method of play of claim 6 wherein simulating stealing $2^{nd}$ or $3^{rd}$ base requires prior to a pitch, the team at bat declaring he intends to attempt a steal so that each player rolls a die, and if the batting team rolls the higher number the steal attempt is successful, and if the team in the field rolls the same or higher number the base runner is out.

8. The baseball board game method of play of claim 6 wherein simulating stealing home for a runner on third base requires the batting team only rolling a die and declaring a single number such that if that number is rolled, the steal of home is successful, else if the number is not rolled, the runner is out; wherein with multiple runners on base the same rules apply but only to the lead runner, the trailing base runner will always advance automatically.

9. The baseball board game method of play of claim 6 wherein simulating a ground out with runners in non-force situation ($2^{nd}$ base, $2^{nd}$ & $3^{rd}$ base, $3^{rd}$ base) requires allowing the Batting team to declare if he wants to try to advance runners, if batting team chooses not to advance, the ground out will remain in effect, if the batting team wants to attempt to advance, then each player shall role the dice, if defending team rolls the higher number the lead runner is declared out and the batter is safe at first, if the batting team rolls a higher number all runners advance.

10. The baseball board game method of play of claim 6 wherein simulating a fly out with runners on base situation requires allowing the Batting team to declare if he wants to try to advance the runner by tagging up, each player shall roll a die, if batting team rolls the higher number the base runner advances, if defending team rolls the higher number the base runner is declared out.

11. The baseball board game method of play of claim 6 wherein rolled dice are six sided.

* * * * *